US008470236B2

(12) United States Patent
Young

(10) Patent No.: US 8,470,236 B2
(45) Date of Patent: Jun. 25, 2013

(54) PROCESS OF MAKING A NON-WOVEN WEB

(75) Inventor: Patrick Henry Young, Colonial Heights, VA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 667 days.

(21) Appl. No.: 12/623,632

(22) Filed: Nov. 23, 2009

(65) Prior Publication Data

US 2010/0129628 A1 May 27, 2010

Related U.S. Application Data

(60) Provisional application No. 61/117,720, filed on Nov. 25, 2008.

(51) Int. Cl.

| | |
|---|---|
| ***D01D 5/08*** | (2006.01) |
| ***D01D 5/18*** | (2006.01) |
| ***D04H 3/00*** | (2012.01) |

(52) U.S. Cl.

USPC ..... 264/555; 264/103; 264/211.1

(58) Field of Classification Search

USPC ..... 264/103, 211.1, 555

See application file for complete search history.

(56) References Cited

U.S. PATENT DOCUMENTS

| | | | | |
|---|---|---|---|---|
| 4,127,706 | A | 11/1978 | Martin et al. | |
| 4,536,361 | A | 8/1985 | Torobin | |
| 5,494,616 | A | 2/1996 | Voelker et al. | |
| 6,032,807 | A * | 3/2000 | Sternberg et al. | 264/258 X |
| 6,183,670 | B1 | 2/2001 | Torobin et al. | |
| 6,315,806 | B1 | 11/2001 | Torobin et al. | |
| 6,319,865 | B1 | 11/2001 | Mikami | |
| 6,382,526 | B1 | 5/2002 | Reneker et al. | |
| 6,520,425 | B1 | 2/2003 | Reneker | |
| 6,695,992 | B2 | 2/2004 | Reneker | |
| 2002/0060382 | A1 * | 5/2002 | Luo et al. | 264/555 |
| 2006/0084340 | A1 | 4/2006 | Bond et al. | |
| 2008/0242171 | A1 | 10/2008 | Huang et al. | |

FOREIGN PATENT DOCUMENTS

| | | |
|---|---|---|
| DE | 102005048939 | 1/2007 |
| DE | 102007027014 | 12/2008 |
| GB | 1346231 | 2/1974 |
| WO | WO 2008062784 | 7/2008 |

OTHER PUBLICATIONS

Ward G F, Meltblown Nanofibres for Nonwoven Filtration Applicaitons,Filtration and Separation Elsevier Advanced Technology, Oxford GB, vol. 38,No. 9,Nov. 1, 2001, pp. 42-43.

PCT International Search Report and Written Opinion for the International Application No. PCT/US2009/065636 dated Feb. 3, 2010.

* cited by examiner

*Primary Examiner* — Leo B Tentoni

(57) ABSTRACT

A non-woven web, comprising one or more polymeric fibers, wherein the number-average fiber diameter distribution of said one or more polymeric fibers conforms to a Johnson unbounded distribution. Non-woven webs comprising such polymeric fibers are rendered with mean-flow pore size and porosity desirable for specific filtration applications such as hepafiltration.

2 Claims, 1 Drawing Sheet

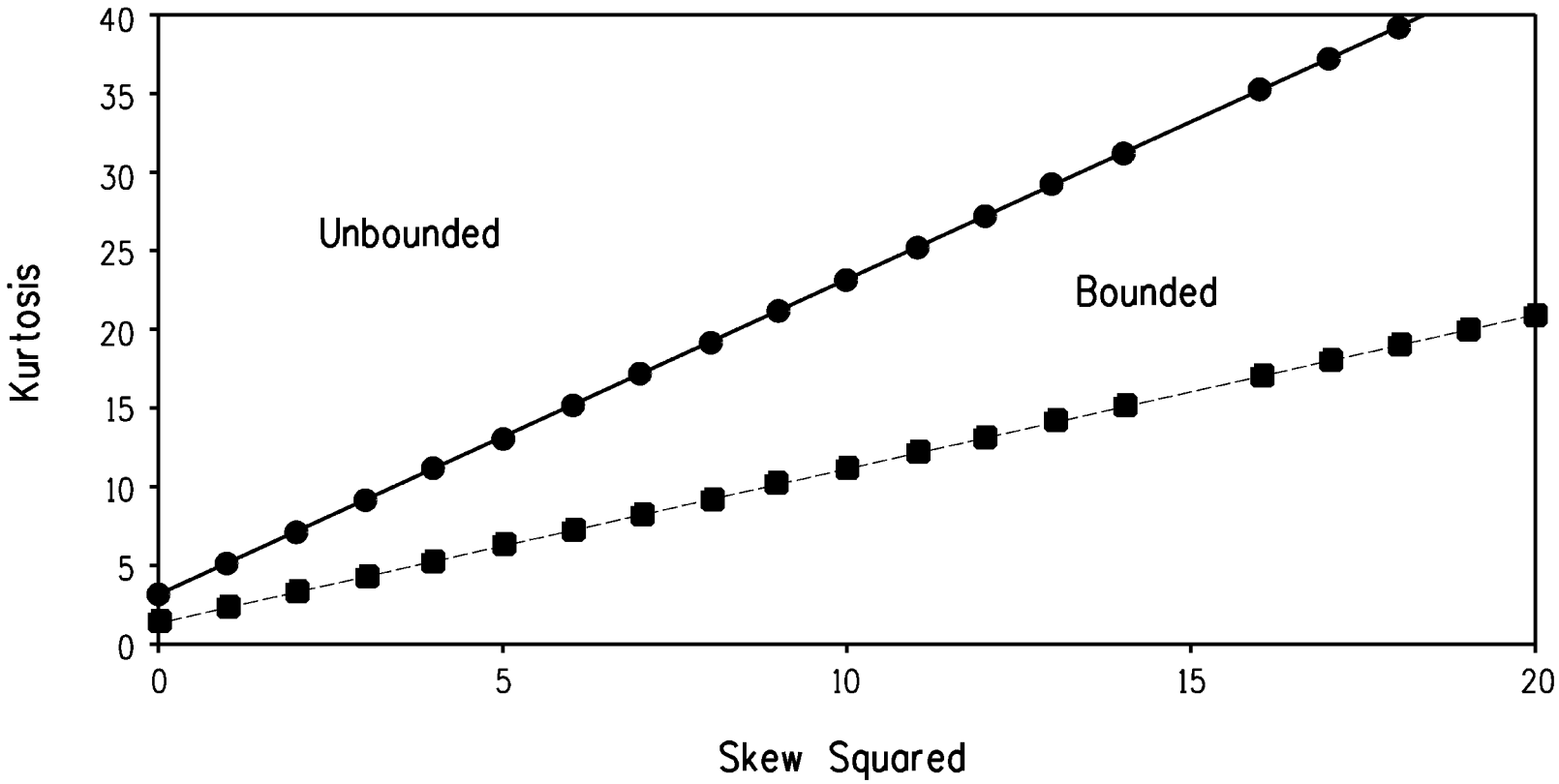
Kurtosis
40
35
30
25
20
15
10
5
0
Unbounded
Bounded
0
5
10
15
20
Skew Squared

PROCESS OF MAKING A NON-WOVEN WEB

FIELD OF THE INVENTION

This invention relates to non-woven webs of polymeric materials. Specifically, this invention relates to non-woven webs comprising polymeric fibers with a number-average fiber diameter distribution conforming to a Johnson unbounded distribution.

BACKGROUND

Non-woven webs used as filtration media often comprise two or more kinds of fibers, each having a different average diameter that renders the non-woven web capable of filtering particles in a broad size-range. Generally, the different kinds of fibers lie in different layers of the web—for example, a filtration web comprising a layer of 0.8 and 1.5-μm diameter microfibers melt-blown onto a spun-bonded web. Such small microfibers, exposed on the top of the web, however, are fragile and disrupt even under normal handling and use. Also, fine-diameter fibers have lower individual-fiber weight, making their transport and retention in an efficient fiber stream difficult. In addition, the fine-diameter fibers tend to scatter as they issue from a melt-blowing die rather than travel as a contained stream to a collector.

Another example of multi-layer, multi-diameter non-woven webs is the so-called SMS webs, comprising a layer of spun-bonded fibers, a layer of melt-blown microfibers, and another layer of spun-bonded fibers. Such multi-layered webs are thicker and heavier and their manufacturing is complex.

Combination webs, where a stream of fibers is mixed with another stream of fibers, are known—for example, a composite web formed by introducing secondary stream of pulp fibers, staple fibers, melt-blown fibers and continuous filaments into a primary stream of melt-blown fibers, followed by hydroentangling the deposited admixture. The web is unoriented, which gives good isotropic properties. However, the art fails to teach a web comprising a coherent matrix of continuous, oriented, thermally-bonded melt-spun fibers with microfibers dispersed in them.

Similarly, small-diameter, oriented, melt-blown fibers (for example less than 1 μM diameter) to which non-oriented melt-blown fibers may be added, are known. But once again the art fails to teach a coherent matrix of bonded melt-spun fibers in which melt-blown microfibers are dispersed.

Also known are filter elements comprising a porous molded web that contains thermally-bonded, staple fibers, and non-thermally bonded, electrically charged microfibers, with the porous molded web being generally retained in its molded configuration by bonds between the staple fibers at points of fiber intersection.

A nanofiber filter media layer is typically provided along an upstream face surface of a bulk filter media including a layer of coarse fibers. The nanofibers extend parallel to the face of the bulk filter media layer and provide high-efficiency filtering of small particles in addition to the filtering of larger particles provided by the coarse filter media. The nanofibers are provided in a thin layer laid down on a supporting substrate and/or used in conjunction with protective layers in order to attain a variety of benefits, including increased efficiency, reduced initial pressure drop, cleanability, reduced filter media thickness and/or to provide an impermeability barrier to certain fluids, such as water droplets. Previous approaches demonstrate several inherent disadvantages, such as a lack of supporting substrate, nanofiber layer/substrate delamination, rapid plugging of the filter by captured contaminants, and the alignment of nanofibers parallel to the media face surface.

Thus, there is a need for non-woven filtration media that can be customized for the rigors of a particular application, particularly, applications where the mean-flow pore diameter of the filtration media is below about 2 μM.

The present invention discloses a novel process for manufacturing non-woven webs with specific fiber diameter properties, and such non-woven webs. Specifically, non-woven webs of the present invention are useful in applications such as hepa filtration that require a lowered mean-flow pore diameter, for example, below about 2 μm. By controlling the statistical parameters of the fiber diameter the present invention prepares non-woven web that will ensure such lowered mean-flow pore diameter.

SUMMARY OF THE INVENTION

The present invention is directed towards a non-woven web, comprising one or more polymeric fibers with a number average fiber diameter distribution that conforms to a Johnson unbounded distribution. In a preferred embodiment, the one or more fibers within the fiber diameter distribution are produced from the same spinning head. The web may be prepared by centrifugal spinning of a polymer melt or a polymer solution.

In a further embodiment of the web, the polymeric fiber or fibers have a number average mean fiber size of less than one μm. In a still further embodiment the web of the invention has a Frazier porosity in the range of from about 5 $ft^3 \cdot ft^{-2} min^{-1}$ (0.0254 $m^3 \cdot m^{-2} \cdot sec^{-1}$) to about 100 $ft^3$ $ft^{-2} min^{-1}$ (0.508 $m^3 \cdot m^{-2} \cdot sec^{-1}$) at a basis weight of approximately 25 $g \cdot m^{-2}$.

The invention is also directed towards a method for optimizing the mean-flow pore-size of a non-woven web, comprising spinning one or more polymeric fibers, wherein the number-average fiber diameter distribution of said one or more polymeric fibers conforms to a Johnson unbounded distribution.

In one embodiment, the number-average mean fiber size of said one or more polymeric fibers is less than 1,000 nm.

In one embodiment of the method, the spinning comprises the steps of:

(i) supplying a spinning melt or solution of at least one thermoplastic polymer to an inner spinning surface of a rotating distribution disc having a forward-surface, fiber-discharge edge;

(ii) issuing said spinning melt or solution along said inner spinning surface of said rotating distribution disc so as to distribute said spinning melt or solution into a thin film and toward the forward-surface, fiber-discharge edge; and (iii) discharging separate molten or solution polymer fiber streams from said forward-surface, discharge-edge into a gas stream to attenuate the fiber stream to produce polymeric fibers that have a mean fiber diameter less than about 1,000 nm;

wherein said polymer melt or solution has a viscosity that is above a minimum effective viscosity for producing said polymeric fibers with the number-average fiber diameter distribution of said polymeric fibers conforms to a Johnson unbounded distribution; and/or wherein said polymer melt or solution has a flow-rate that is below a maximum effective flow-rate for producing said polymeric fibers with the number-average fiber diameter distribution of said polymeric fibers conforms to a Johnson unbounded distribution; and/or wherein said polymer solution has a concentration that is above a minimum effective concentration for producing said polymeric fibers with the number-average fiber diameter distribution of said polymeric fibers conforms to a Johnson unbounded distribution; and/or wherein the rotational speed of said rotating distribution disc is below a maximum effective rotational speed for producing said polymeric fibers with the number-average fiber diameter distribution of said polymeric fibers conforms to a Johnson unbounded distribution.

Finally, this invention also relates to a non-woven web, prepared by the above-described method.

BRIEF DESCRIPTION OF THE DRAWING

FIG. 1 shows a plot of Kurtosis v. Skewness squared that defines when the number-average diameter distribution of the polymeric fibers of the non-woven web is Johnson unbounded.

DETAILED DESCRIPTION OF THE INVENTION

This invention generally relates to non-woven webs of polymeric fibers with a specific size-distribution of the fibers.

The term "non-woven" means a web including a multitude of randomly distributed polymeric fibers. The polymeric fibers generally can be bonded to each other or can be unbonded. The polymeric fibers can be staple fibers or continuous fibers. The polymeric fibers can comprise a single material or a multitude of materials, either as a combination of different fibers or as a combination of similar fibers each comprised of different materials.

The term "nanofiber" as used herein refers to fibers having a number average diameter of the cross-section less than about 1000 nm. Preferably, the number average diameter is in the range of from about 10 nm to about 800 nm. In the preferred ranges, the number-average diameter of the fibers is in the range of from about 50 nm to about 500 nm or from about 100 to about 400 nm. The term diameter as used herein includes the greatest cross-section of non-round shapes. The number-average diameter of the fibers is defined as a random sampling of a minimum of 100 distinguishable fibers from each measured sample.

A "nanoweb" is a non-woven web of polymeric nanofibers. The terms "nanoweb" and "nanofiber web" are used synonymously herein.

By "centrifugal spinning" is meant a fiber spinning process, comprising supplying a spinning melt or solution of at least one thermoplastic polymer to an inner spinning surface of a heated, rotating distribution disc having a forward-surface, fiber-discharge edge. The polymer melt or solution is issued along said inner spinning surface so as to distribute the spinning melt or solution into a thin film toward the forward-surface, fiber-discharge edge. The melt or solution is discharged as separate polymer fiber streams from the forward-surface, discharge edge into a gas stream that attenuates the fiber stream producing polymeric nanofibers that have a mean fiber diameter of less than about 1,000 nm. Centrifugal spinning is described U.S. Pat. No. 5,494,616, which is fully incorporated by reference herein.

I. Johnson Distribution

When referring to the shape of frequency or probability distributions of the number-average diameter of the polymeric fibers, "Skewness" refers to asymmetry of the distribution. On a plot of the number average diameter as a function of the number of measurements, as understood by a person of ordinary skill in the pertinent art, a distribution with an asymmetric tail extending out to the right is referred to as "positively skewed" or "skewed to the right," while a distribution with an asymmetric tail extending out to the left is referred to as "negatively skewed" or "skewed to the left." Skewness can range from minus infinity to positive infinity.

The formula used in the present disclosure for Skewness ($\beta_1$) is:

$$\beta_1 = \frac{N}{(N-1)(N-2)} \sum [(x_i - X)/s]^3$$

where:

"$x_i$" is the $i^{th}$ observation;

"X" is mean of the observations;

"N" is the number of observations; and

"s" is the standard deviation.

On the other hand, Kurtosis is one measure of how different a distribution is from the normal distribution of the number average diameter of the polymeric fibers in the context of the present invention. A positive value typically indicates that the distribution has a sharper peak than the normal distribution on a plot of the number average diameter as a function of the number of measurements, as understood by a person of ordinary skill in the pertinent art. A negative value indicates that the distribution has a flatter peak than the normal distribution.

The formula used here for kurtosis ($\beta_2$) is:

$$\beta_2 = \left\{ \frac{N(N+1)}{(N-1)(N-2)(N-3)} \sum [(x_i - X)/s]^4 \right\} - \frac{3(N+1)^2}{(N-2)(N-3)}$$

where:

"$x_i$" is the $i^{th}$ observation;

"X" is mean of the observations;

"N" is the number of observations; and

"s" is the standard deviation.

As understood by a person of ordinary skill in the pertinent art, a "Johnson map" is a four-parameter map and can be constructed from the two of the four moments of the dataset. The four moments of the fiber distribution dataset are Mean, Variance, Skewness, and Kurtosis. A normal distribution is first attempted on the data. From the Null hypothesis in statistics, to determine the normality of the number-average diameter distributions of the polymeric fibers, if the P-value is less than 0.05 then there is a 95% confidence that the data are not normal. A Johnson map is then done. On the other hand, if a P-value of greater than 0.05 is achieved for a normal distribution, then a Johnson map is not done.

The critical moments in the graphing procedure of the Johnson map are Skewness ($\beta_1$) and Kurtosis ($\beta_2$). Skewness and kurtosis were measured using Minitab version 15 software. The Johnson distribution is identified using the map shown in FIG. 1, which is a plot of the Skewness-squared as a function of Kurtosis. The result from a Johnson map can either be unbounded, bounded, lognormal, or forbidden (none). The map indicates the regions in Kurtosis and Skewness-squared space into which the four types of transformations fall. Points on the solid black line correspond to lognormal distributions.

II. Fiber Production

The present invention is directed towards a non-woven web comprising one or more polymeric fibers with a number-average fiber diameter distribution that conforms to a Johnson unbounded distribution. The web may be prepared by centrifugal spinning of a polymer melt or a polymer solution.

In a further embodiment the of the web, the polymeric fiber or fibers have a mean fiber size of less than one micron. In a still further embodiment the web of the invention has a Frazier porosity in the range of from about 5 $ft^3 \cdot ft^{-2} min^{-1}$ (0.0254 $m^3 \cdot m^{-2} \cdot sec^{-1}$) to about 100 $ft^3 \cdot ft^{-2} min^{-1}$ (0.508 $m^3 \cdot m^{-2} \cdot sec^{-1}$) at a basis weight of approximately 25 $g \cdot m^{-2}$.

The one or more polymeric fibers within a given distribution are preferably produced from the same spinning head. By this is meant that the distribution that is obtained is intrinsic to the spinning process and is not obtained by blending fibers from different distributions to obtain the desired distribution.

The invention is also directed towards a method for controlling or optimizing the mean-flow pore size of a non-woven web by making the web with a number average fiber distribution that conforms to a Johnson unbounded distribution. In a preferred embodiment, the one or more fibers within a given distribution are preferably produced from the same spinning head.

In a further embodiment, the distribution can be controlled by using a spinning solution or melt that has a viscosity that is above a minimum effective viscosity for the process to produce the desired distribution. That viscosity can be established by routine experimentation on the process.

In another embodiment, the distribution can be controlled by having said polymer melt or solution flow-rate that is below a maximum effective flow-rate for producing the desired Johnson unbounded distribution. That flow-rate can be established by routine experimentation on the process.

In another embodiment, the distribution can be controlled by having said polymer solution concentration that is above a minimum effective concentration for producing the desired Johnson unbounded distribution. That concentration can be established by routine experimentation on the process.

In another embodiment, the distribution can be controlled by maintaining the rotational speed of said rotating distribution disc below a maximum effective rotational speed for producing the desired Johnson unbounded distribution. That rotational speed can be established by routine experimentation on the process.

The effective viscosity, effective flow-rate, effective polymer solution concentration, and the effective rotational speed will depend on the type of thermoplastic polymer, polymer blend, its molecular weight, and other additives in the polymer. Clearly, the temperature of spinning and other spinning parameters well-known to a person skilled in the art will contribute toward arriving at a Johnson unbounded distribution for the number-average fiber diameter distribution of the polymeric fibers.

Although the present invention exemplifies a centrifugal spinning process, the polymeric fibers can be prepared by any means known to one skilled in the art. For example, the nano-web of the method may comprise a non-woven web made by a process selected from the group consisting of electroblowing, electrospinning, centrifugal spinning and melt blowing. The media may further comprise a scrim support layer in contact with either the nanofiber web or the upstream layer.

The as-spun nanoweb may comprise primarily or exclusively nanofibers, advantageously produced by electrospinning, such as classical electrospinning or electroblowing, and in certain circumstances, by melt-blowing or other such suitable processes. Classical electrospinning is a technique illustrated in U.S. Pat. No. 4,127,706, incorporated herein in its entirety, wherein a high voltage is applied to a polymer in solution to create nanofibers and non-woven mats.

The "electroblowing" process is disclosed in World Patent Publication No. WO 03/080905, incorporated herein by reference in its entirety. A stream of polymeric solution comprising a polymer and a solvent is fed from a storage tank to a series of spinning nozzles within a spinneret, to which a high voltage is applied and through which the polymeric solution is discharged. Meanwhile, compressed air that is optionally heated is issued from air nozzles disposed in the sides of, or at the periphery of the spinning nozzle. The air is directed generally downward as a blowing gas stream which envelopes and forwards the newly issued polymeric solution and aids in the formation of the fibrous web, which is collected on a grounded porous collection belt above a vacuum chamber. The electroblowing process permits formation of commercial sizes and quantities of nanowebs at basis weights in excess of about 1 $g/m^2$, even as high as about 40 $g/m^2$ or greater, in a relatively short time period.

Nanowebs can also be produced for the invention by the process of centrifugal spinning. Centrifugal spinning, as previously discussed, is a fiber forming process comprising the steps of supplying a spinning solution having at least one polymer, either in a molten condition or dissolved in at least one solvent, to a rotary sprayer having a rotating conical nozzle and a forward surface discharge edge; issuing the spinning solution or melt from the rotary sprayer so as to distribute said spinning solution toward a forward surface of the discharge edge of the nozzle; and forming separate fibrous streams from the spinning solution while the solvent, if it is used, vaporizes to produce polymeric fibers in the presence or absence of an electrical field. A shaping fluid can flow around the nozzle to direct the spinning solution away from the rotary sprayer. The fibers can be collected onto a collector to form a fibrous web.

Nanowebs can be further produced for the media of the invention by melt processes such as melt blowing. For example, nanofibers can include fibers made from a polymer melt. Methods for producing nanofibers from polymer melts are described for example in U.S. Pat. No. 6,520,425; U.S. Pat. No. 6,695,992; and U.S. Pat. No. 6,382,526 to the University of Akron, U.S. Pat. No. 6,183,670; U.S. Pat. No. 6,315,806; and U.S. Pat. No. 4,536,361 to Torobin, et al., and U.S. publication number 2006/0084340.

If a solvent is used, the spinning solution comprises at least one polymer dissolved in at least one solvent if the polymer is to be solvent spun, or melted into a fluid state if a polymer melt is to be spun. For the solution spinning process, any fiber forming polymer able to dissolve in a solvent that can be vaporized can be used. Suitable polymers for both melt and solution spinning include polyalkylene oxides, poly(meth) acrylates, polystyrene-based polymers and copolymers, vinyl polymers and copolymers, fluoropolymers, polyesters and copolyesters, polyurethanes, polyalkylenes, polyamides, and polyaramids. Classes of polymers such as thermoplastic polymers, liquid crystal polymers, engineering polymers, biodegradable polymers, bio-based polymers, natural polymers, and protein polymers can also be used. The spinning solution can have a polymer concentration of about 1% to about 90% by weight of polymer in the spinning solution. Also, in order to assist the spinning of the spinning solution or melt, the spinning solution can be heated or cooled. Generally, a spinning solution with a viscosity from about 10 cP to about 100,000 cP is useful.

Additionally, polymer blends can also be produced as long as the two or more polymers are soluble in a common solvent or can be melt-processed. A few examples would be but not limited to: poly(vinylidene fluoride)-blend-poly(methyl methacrylate), polystyrene-blend-poly(vinylmethylether), poly(methyl methacrylate)-blend-poly(ethylene oxide), poly (hydroxypropyl methacrylate)-blend poly(vinylpyrrolidone), poly(hydroxy butyrate)-blend-poly(ethylene oxide), protein blend-polyethyleneoxide, polylactide-blend-polyvinylpyrrolidone, polystyrene-blend-polyester, polyester-blend-poly (hyroxyethyl methacrylate), poly(ethylene oxide)-blend poly (methyl methacrylate), poly(hydroxy styrene)-blend-poly (ethylene oxide)).

Optionally, an electrical field can be added to the process. A voltage potential can be added between the rotary sprayer and the collector. Either the rotary sprayer or the collector can be charged with the other component substantially grounded or they can both be charged so long as a voltage potential exists between them. In addition, an electrode can be positioned between the rotary sprayer and the collector wherein the electrode is charged so that a voltage potential is created between the electrode and the rotary sprayer and/or the collector. The electrical field has a voltage potential of about 1 kV to about 150 kV. Surprisingly, the electrical field seems to have little effect on the average fiber diameter, but does help the fibers to separate and travel toward a collector so as to improve laydown of the fibrous web.

EXAMPLES

I. Test Methods

In the description above and in the non-limiting examples that follow, the following test methods were employed to determine various reported characteristics and properties.

A. Fiber Diameter

Fiber diameter was determined as follows. Ten scanning electron microscope (SEM) images at 5,000× magnification were taken of each nanofiber layer sample. A manual counting procedure of fiber diameter was used. Multiple fiber diameter measurements can occur on a single fiber and so the measurement is not limited by the number of fibers that appear in the SEM field.

In general, the edge of a randomly selected fiber is sought and then measured across the width (perpendicular to fiber direction at that spot) to the opposite edge of the fiber. A scaled and calibrated image analysis tool provides the scaling to get the actual reading in mm or microns. No more than ten (10) distinguishable fiber diameters were measured from each SEM micrograph. A total of at least one hundred (100) clearly distinguishable fibers were measured from each sample and recorded. Defects were not included (i.e., lumps of nanofibers, polymer drops, intersections of nanofibers). The data including fiber size distributions were all recorded and statistical analysis was carried out as described above using a commercial software package (Minitab 15 for Windows, Minitab, Inc., State College, Pa.). The definitions of Skewness and Kurtosis from that software were used to define whether a distribution was Johnson bounded or unbounded.

B. Viscosity

Viscosity was measured on a Thermo RheoStress 600 rheometer (Newington, N.H.) equipped with a 20 mm parallel plate. Data were collected over 4 minutes with a continuous shear rate ramp from 0 to 1,000 $s^{-1}$ at 23° C. and reported in cP at 10 $s^{-1}$.

C. Frazier Permeability

Frazier Permeability is a measure of air permeability of porous materials and is measured in cubic feet per square foot per minute. It measures the volume of air flow through a material at a differential pressure of 0.5 inches of water (1.25 cm of water). An orifice is mounted in a vacuum system to restrict flow of air through the sample to a measurable amount. The size of the orifice depends on the porosity of the material. Frazier permeability, which is also referred to a Frazier porosity, was measured using a Sherman W. Frazier Co. dual manometer with calibrated orifice in units of $ft^3/ft^2/min$.

D. Mean Pore Size

Mean Pore Size is a measure of the material pore size at which half of the total air flow through the sample occurs through pores larger than the mean, and half of the air flow occurs through pores smaller than the mean. Mean-flow pore size was measured according to the general teachings of ASTM F31 6-03 using a Capillary Flow Porometer (Model CFP 1500 AEXL from Porous Materials Inc., Ithaca, N.Y.). The sample membrane was placed into the sample chamber and wet with SilWick Silicone Fluid (Porous Materials, Inc.; Ithaca, N.Y.) having a surface tension of 19.1 dynes/cm. The bottom clamp of the sample chamber had a 2.54 cm diameter, 3.175 mm thick porous metal disc insert (Mott Metallurgical, Farmington, Conn., 40 μm porous metal disk) and the top clamp of the sample chamber had a 3.175 mm diameter hole. The values presented for mean-flow pore size were the average of three measurements.

E. Flux Barrier

Flux barrier is a measure of small particle filtration efficiency without sacrificing air or liquid flow. The property is defined as the Frazier Porosity $m^3 \cdot m^{-2} \cdot sec^{-1}$ divided by the mean flow pore size in microns.

II. Example 1

This example demonstrates the preparation of a nanofiber web on a Typar (polypropylene nonwoven available from BBA Fiberweb; Old Hickory, Tenn.) scrim wherein the nanofibers are laidown without the use of an electric field.

Continuous fibers were made using a standard Aerobell rotary atomizer and control enclosure for high voltage, turbine speed and shaping air control from ITW Automotive Finishing Group (location). The bell-shaped nozzle used was an ITW Ransburg part no. LRPM4001-02. A spinning solution of 30% polyvinylidene fluoride (Kynar 711, Atochem North America, Inc.) in 70% dimethyl formamide by weight was mixed in a 55° C. water bath until homogeneous and poured into a Binks 83C-220 pressure tank for delivery to a PHD 4400, 50-ml syringe pump from Harvard Apparatus (Holliston, Mass.). The polymer solution was then delivered from the syringe pump to the rotary atomizer through a supply tube. The pressure on the pressure tank was set to a constant 15 psi. Flow rates through the rotary atomizer were controlled with the syringe pump. The shaping air was set at a constant 30 psi. The bearing air was set at a constant 95 psi. The turbine speed was set to a constant 10K rpm. The bell cup was 57 mm in diameter. The polymer solution was spun at 30° C. No electrical field was used during this test. Fibers were collected on a Typar non-woven collection screen that was held in place 12 inches away from the bell-shaped nozzle by a piece of stainless steel sheet metal.

The results of this test are shown in Table 1 and the data collected are shown in Table 2. More than one-hundred fibers were measured and shown to follow a Johnson unbounded distribution with a flux barrier of 0.0359.

III. Comparative Example 1

Comparative Example 1 was prepared similarly to Example 1, except a spinning solution of 25% (instead of 30%) polyvinylidene fluoride (Kynar 711, Atochem North America, Inc.) in 75% dimethyl formamide was used, a turbine speed of 40K rpms, a spinning temperature of 55° C., and a flow rate of 15 ml/min.

The results of this test are shown in Table 1 and the data collected are shown in Table 2. Over one hundred fibers were measured and shown to follow a Johnson bounded distribution with a mean-flow pore size much higher than in Example 1 and a flux barrier of 0.00011. The higher mean-flow pore size is due to the Johnson distribution not being unbounded.

IV. Example 2

This example demonstrates the preparation of a nanofiber web on a Typar scrim wherein the nanofibers are laidown with the use of an electric field.

Example 2 was prepared similarly to Example 1, except an electrical field was applied. The electrical field was applied directly to the rotary atomizer by attaching a high voltage cable to the high voltage lug on the back of the rotary atomizer. The rotary atomizer was completely isolated from ground using a large Teflon® stand so that the closest ground to the bell-shaped nozzle was the stainless steel sheet metal backing the Typar collection belt. A +50 kV SL600 power supply (Spellman Electronics Hauppauge, N.Y.) was used in current control mode and the current was set to 0.02 mA. The high voltage ran at about 50 kV. The lay down of the fiber was much better than in Example 1 in that the coverage was very uniform over the collection area.

The results of this test are shown in Table 1 and the data collected are shown in Table 2. Over one hundred fibers were measured and shown to follow a Johnson unbounded distribution with a mean-flow pore size of 0.8 μm and a flux barrier of 0.012.

V. Comparative Example 2

Comparative Example 2 was prepared similarly to Comparative Example 1, except an electrical field was applied. The electrical field was applied directly to the rotary atomizer by attaching a high voltage cable to the high voltage lug on the back of the rotary atomizer. The rotary atomizer was completely isolated from ground using a large Teflon® stand so that the closest ground to the bell-shaped nozzle was the stainless steel sheet metal backing the Typar collection belt. A +50 kV power supply was used in current control mode and the current was set to 0.02 mA. The high voltage ran at about 50 kV. The lay down of the fiber was much better than in Comparative Example 1 in that the coverage was very uniform over the collection area.

The results of this test are shown in Table 1 and the data collected are shown in Table 2. More than one-hundred fibers were measured and shown to follow a Johnson bounded distribution with a mean-flow pore size much lower than in comparative Example 1 due to the improved laydown from the applied electric field. However, the mean-flow pore size of Comparative Example 2 is not as low as Example 2 because the Johnson map does not result in an unbounded distribution and the flux barrier is 0.0046.

VI. Example 3

Example 3 was prepared similarly to Example 1, except a 70 mm bell cup was used. Fibers were collected on a Typar non-woven collection screen that was held in place 12 inches away from the bell-shaped nozzle by stainless steel sheet metal.

The results of this test are shown in Table 1 and the data collected are shown in Table 2. More than one-hundred fibers were measured and shown to follow a Johnson unbounded distribution with a flux barrier of 0.872. Example 3 shows a higher mean-flow pore size than Example 1 demonstrating that even with though a Johnson unbounded distribution is detected, a smaller cup size will result in an even lower mean-flow pore sizes.

VII. Comparative Examples 3-5

A Nylon 6,6 solution in formic acid was spun by an electrospinning apparatus. The concentration of the polymer solution was 25% by weight. The collector speed was held at 50 rpm. The applied voltage ranged form 20 to 50 KV, and the distance between the nozzle tip and collector was fixed at no mm. The total setup and process parameters are shown in Reference 1, Park, H. S., Park, Y. O., "Filtration Properties of Electrospun Ultrafine Fiber Webs", Korean J. Chem. Eng., 22(1), pp. 165-172 (2005).

Fiber size distributions were presented on page 157 of Reference 1. These distribution patterns were reproduced in Minitab version 15 using the uniform random number generator for each respective bin of data. The statistics along with Skewness and Kurtosis were calculated to identify the correct Johnson map and shown in Table 3. Comparative Examples 3-5 had mean-flow pore sizes ranging between 2.93 and 6.06 μm due to their electrostatic laydown. However, none of the fiber distributions resulted in a Johnson unbounded map and none gave a mean-flow pore size below one μm as in Example 2.

VIII. Comparative Examples 4

A 25% by weight solution poly(vinylidene fluoride) was made in dimethyl acetamide. An electrospinning apparatus using a 1-mm diameter syringe needle and a drum shaped counter electrode was used to make fibers. The tip to collector distance was 15 cm and the applied voltage was 10 KV. The total setup and process parameters are shown in Reference 2, Choi, S. S., Lee, Y. S., Joo, C. W., Lee, S. G., Park, J. K., Han, K. S., "Electrospun PVDF nanofiber web as polymer electrolyte or separator", Electrochimica Acta, 50, pp. 339-34 (2004).

A fiber size distribution plot is presented on page 341 of Reference 2. These distribution patterns were reproduced in Minitab version 15 using the uniform random number generator for each respective bin of data. The statistics along with Skewness and Kurtosis were calculated to identify the correct Johnson map and shown in Table 3. Comparative Example 4 had a mean-flow pore size between 3.28 μm due to the electrostatic laydown. However, the fiber distribution was normal and the mean-flow pore size was not below one μm as in Example 2.

TABLE 1

| Test | Example 1 | Comparative Example 1 | Example 2 | Comparative Example 2 | Example 3 |
|---|---|---|---|---|---|
| Viscosity (cP) | 2650 | 572 | 2650 | 572 | 2650 |
| Applied Voltage (KV) | 0 | 0 | 50 | 50 | 0 |
| Polymer Concentration (%) | 30 | 25 | 30 | 25 | 30 |
| Solution Temperature (° C.) | 30 | 55 | 30 | 55 | 30 |
| Bell Cup Size (mm) | 57 | 57 | 57 | 57 | 70 |
| Rotational Speed (KRPM) | 10 | 40 | 10 | 40 | 10 |
| Flow Rate (ml/min) | 2.0 | 15 | 2.0 | 15 | 2.0 |

TABLE 2

| Properties | Example 1 | Comparative Example 1 | Example 2 | Comparative Example 2 | Example 3 |
|---|---|---|---|---|---|
| Johnson Mapping | Unbounded | Bounded | Unbounded | Bounded | Unbounded |
| Skewness | 3.74 | 1.05 | 2.94 | 1.19 | 1.98 |
| Kurtosis | 31.48 | 1.59 | 22.17 | 1.76 | 11.68 |
| Average Fiber Diameter (nm) | 174.7 | 117.3 | 238.2 | 145.2 | 124.28 |
| Fiber Standard Deviation | 123.70 | 36.07 | 106.8 | 44.2 | 40.54 |
| Mean-flow Pore Size (μm) | 10.3 | 910 | 0.8 | 88 | 22.09 |
| Frazier Porosity ($m^3 \cdot m^{-2} \cdot sec^{-1}$) | 0.370 | 0.841 | 0.048 | 0.403 | 0.490 |
| Flux Barrier | 0.0360 | 0.0011 | 0.060 | 0.0046 | 0.022 |
| Basis Weight ($g/m^2$) | 18.63 | 17.31 | 23.8 | 22.5 | 19.44 |

TABLE 3

| Properties | Comparative Example 3 | Comparative Example 4 | Comparative Example 5 | Comparative Example 6 |
|---|---|---|---|---|
| Johnson Mapping | None | Normal | None | Normal |
| Skewness | 0.58 | 0.09 | 0.73 | 0.10 |
| Kurtosis | 0.22 | 0.14 | 1.08 | −0.03 |
| Average Fiber Diameter (nm) | 577.63 | 460 | 365.08 | 391.72 |
| Fiber Standard Deviation | 158.46 | 119.68 | 122.53 | 123.01 |
| Mean-flow Pore Size (μm) | 6.06* | 4.40* | 2.93* | 3.28** |
| Basis Weight ($g/m^2$) | 17.75* | 18.22* | 15.89* | NA |

*As measured per Reference 1.
**As measured per Reference 2.

I claim:

1. A method for optimizing the mean-flow pore-size of a non-woven web, comprising spinning one or more polymeric fibers, wherein the number-average fiber diameter distribution of said one or more polymeric fibers conforms to a Johnson unbounded distribution.

2. The method of claim 1, wherein said spinning comprises the steps of:

(i) supplying a spinning melt or solution of at least one thermoplastic polymer to an inner spinning surface of a rotating distribution disc having a forward-surface, fiber-discharge edge;

(ii) issuing said spinning melt or solution along said inner spinning surface of said rotating distribution disc so as to distribute said spinning melt or solution into a thin film and toward the forward-surface, fiber-discharge edge; and (iii) discharging separate molten or solution polymer fiber streams from said forward-surface, discharge-edge into a gas stream to attenuate the fiber stream to produce polymeric fibers that have a mean fiber diameter less than about 1,000 nm;

wherein said polymer melt or solution has a viscosity that is above a minimum effective viscosity for producing said polymeric fibers with the number-average fiber diameter distribution of said polymeric fibers conforms to a Johnson unbounded distribution; and/or wherein said polymer melt or solution has a flow-rate that is below a maximum effective flow-rate for producing said polymeric fibers with the number-average fiber diameter distribution of said polymeric fibers conforms to a Johnson unbounded distribution; and/or wherein said polymer solution has a concentration that is above a minimum effective concentration for producing said polymeric fibers with the number-average fiber diameter distribution of said polymeric fibers conforms to a Johnson unbounded distribution; and/or wherein the rotational speed of said rotating distribution disc is below a maximum effective rotational speed for producing said polymeric fibers with the number-average fiber diameter distribution of said polymeric fibers conforms to a Johnson unbounded distribution.

* * * * *